US007004359B2

(12) United States Patent
Marroncles

(10) Patent No.: US 7,004,359 B2
(45) Date of Patent: Feb. 28, 2006

(54) SPRAYING CAP

(75) Inventor: Alain Marroncles, Saint Maur des Fossés (FR)

(73) Assignee: Lindal Ventil GmbH, (DE)

( * ) Notice: Subject to any disclaimer, the term of this patent is extended or adjusted under 35 U.S.C. 154(b) by 295 days.

(21) Appl. No.: 10/458,210

(22) Filed: Jun. 10, 2003

(65) Prior Publication Data

US 2004/0222245 A1 Nov. 11, 2004

(30) Foreign Application Priority Data

Apr. 24, 2003 (DE) ..... 203 06 719 U

(51) Int. Cl.
*B65D 83/14* (2006.01)

(52) U.S. Cl. ..... 222/402.13; 222/402.12; 222/402.15; 222/402.21

(58) Field of Classification Search ..... 222/402.12, 222/402.13, 402.15, 402.21; 220/254.1, 220/254.4
See application file for complete search history.

(56) References Cited

U.S. PATENT DOCUMENTS 3,107,670 A * 10/1963 Silson et al. ..... 128/200.23
3,109,565 A * 11/1963 Kutik ..... 222/402.11
3,143,254 A * 8/1964 Vanderhyde ..... 222/402.11
3,169,673 A * 2/1965 Focht ..... 222/182
3,209,751 A * 10/1965 Wakeman ..... 128/200.23
3,469,746 A * 9/1969 Melocchi ..... 222/182
3,583,607 A * 6/1971 Beck ..... 222/402.21
3,595,427 A * 7/1971 Markowitz ..... 220/288
3,610,480 A * 10/1971 Lipfert et al. ..... 222/402.21
3,618,827 A * 11/1971 Melocchi ..... 222/162
3,622,053 A * 11/1971 Ryden ..... 222/402.11
3,739,941 A * 6/1973 Ostrwosky et al. .... 222/153.11
3,987,942 A * 10/1976 Morane et al. ..... 222/402.15

FOREIGN PATENT DOCUMENTS

JP 3369563 B2 * 1/2003

* cited by examiner

*Primary Examiner*—Patrick Brinson
(74) *Attorney, Agent, or Firm*—Wall Marjama & Bilinski LLP

(57) ABSTRACT

A spraying cap for a spray container with a valve includes an attachment for the spray container with a connection piece that is connectable with the valve, which runs into a spray nozzle. The spraying cap further includes an actuator element, slewably mounted on the attachment, which in a locked position at least partly covers the spray nozzle and in an opened position sticks off from the spraying cap, and a pressure region in the attachment proximate to the connection piece. A force on the pressure region or on the actuator element in its opened position, wholly or partly pointing into the actuation direction of the valve, opens the valve.

14 Claims, 3 Drawing Sheets

SPRAYING CAP

FIELD OF THE INVENTION

The present invention relates to a spraying cap for a spray container with a valve.

BACKGROUND OF THE INVENTION

One- or several piece spray caps for fingertip spray containers of every kind are sufficiently known. The known spray caps have an actuator element, which releases the discharge of the container content upon pressure with the finger by an user. In this way for example, with aerosol cans or bottles for household use, respectively, the can is held in the hand and is actuated with the index finger by pressing on an actuation knob of the spraying cap. The liquid is then discharged in an angle of 90° to the actuation direction. Usage possibilities for aerosol cans and containers, respectively, can be imagined in which such a position of the spray container aggravates the handling.

SUMMARY OF THE INVENTION

The invention has as an objective to create a spraying cap for spray containers which makes possible a flexible application of the spray container with a simple handling, and has a simple and solid construction at the same time.

The objective is resolved according to the invention by a spraying cap with the features from claim 1. Advantageous designs form the object of the subclaims.

According to the invention, the spray cap for a spray container provided with a valve is provided with an attachment, which has a connection piece connectable with a valve orifice of the spray container. The container content, after its emerging out of the valve orifice, is guided via the connection piece, which runs into the spray nozzle of the spray cap, to the spray nozzle, where it is normally atomised and sprayed. The attachment is provided with a slewably mounted actuator element, which in a locked position covers the spray nozzle and sticks off from the spraying cap in an opened position. In order to prepare the spraying cap for spraying, the actuator element is removed from its locked position, in which the spray nozzle is partly or completely covered, and brought into its opened position. In the opened position, the actuator element sticks off from the spraying cap. Further, the spraying cap has a pressure region in the attachment closely to the connection piece. The pressure region is provided roughly at the site where the actuation region is in conventional spraying caps also. The pressure region does not necessarily imply a particular design, instead the pressure region can be provided in the attachment even without any particular marking. A force upon the pressure region or upon the actuator element in the opened position, pointing wholly or partially into the actuation direction of the valve, opens the valve and thus effects the discharge of the container content. In the locked position of the actuator element the spray nozzle is at least partially covered, so that an actuation is not possible. In the opened position two actuation variants are offered, in one of them the valve can be opened by pressing with the index finger on the pressure region, for instance. Additionally, an actuation of the valve can be brought about when the actuator element sticking off from the spraying cap is pressed. Through this, the user is provided with a larger variety of and with more flexible application possibilities for a spray container with the spraying cap according to the invention.

In a preferred embodiment, the connection piece in a first portion runs in the actuation direction of the valve. Thus, actuation of the valve takes place by exerting a force upon the valve via the connection piece across the pressure region in the attachment and/or the actuator element.

In a particularly preferred embodiment, the orifice portion for the connection piece has an accommodation for a spray insert. The spray insert may be selected depending on the purpose of use and intended application of the spray container, in order to provide a spray nozzle suited for the material and its spray conditions.

In a preferred embodiment, the attachment of the spraying cap has a cylindrical attachment portion with salient projections, which, running partly or completely around the inner side, grasp behind a flange on the spray container in the mounted condition. In this way, the attachment is connected to a spray container, the valve head of which is normally connected with the container body in the form of a salient flange. In principle, every other form of connection of the spraying cap with the container is possible. As spraying cap and spray container with valve are assembled only after filling of the spray container and are not separated from each other on their subsequent use, an attachment with a simple snapping- or catching connection to the spray container is preferred for the spraying cap.

For the reinforcement of the spraying cap, it has reinforcement ribs in its cylindrical attachment portion that run in the actuation direction. The reinforcement ribs may be provided as equally spaced projections in the cylindrical attachment portion of the spraying cap, which reinforce the spraying cap at a small-wall thickness.

For the sake of its pivoting bearing, the actuator element laterally has two desisting pivots. The pivots are provided with a circular cross-section, for instance. For the sake of the pivoting bearing of the actuator element, the attachment has two accommodation bearings for the pivots. The accommodation bearings may be additionally equipped with a safety lug, in order to secure the pivots, and by doing so also the actuator element, against an unintended taking-out from the accommodation bearing.

In order to create two independent actuation variants in the inventive spraying cap, the attachment has a portion extending approximately up to the connection piece on its side opposing the spray nozzle, which is attached to the cylindrical portion and which has the pressure region in the region of the connection piece. Upon a pressure on the pressure region, the portion is moved with the connection piece and relative to the spray container, so that the applied force is transferred to the valve via the connection piece. As in known spraying caps, the attachment is only linked one-side to the connection piece or formed sufficiently elastic for this sake.

The portion which is attached only one-side with the connection piece has a wall element in its portion overlapping the spray nozzle, which has on its free end the accommodation bearings for the actuator element. Thus, in this preferred embodiment, the force acting upon the attachment via the accommodation bearing, as well as a force on the pressure region, is converted into a position change of the connection piece, which leads to a discharge of the container content via the connection piece.

In a preferred embodiment, the attachment is springably attached to the cylindrical attachment portion, the stem of the valve being actuated in its pressed position. In difference to the attachment caps known in the state of the art, the user has the chance to choose between two different actuation modes with the inventive spraying cap.

For the assurance of the actuator element in the locked and/or closed position, the attachment has at least one projection, which co-operates with one or several projections on the actuator element. The co-operating projections may have a ramp-shaped cross section in doing this and grasp behind each other in the assured position, such that a kind of snap connections are formed.

The attachment of the spraying cap is additionally surrounded by a vaulted jacket element, which has two jacket portions edgewise of the nozzle, between which the pressure region, the spray nozzle and the actuator element are disposed. The vaulted jacket element is disposed edgewise from the spray nozzle with one jacket portion, respectively, and allows the attachment to overhang freely with its pressure region and the spray nozzle, preferably in a region between the jacket portions.

In a preferred embodiment, the actuator element in its locked position covers the region between the two jacket portions at least in the region of the aerosol can. Through this, the spraying cap forms an almost closed cap in the locked position of the actuator element, so that a lid for the spraying cap can be omitted. Preferably, the actuator element is secured on the attachment in the locked position.

BRIEF DESCRIPTION OF THE DRAWINGS

A preferred embodiment of the inventive spray cap is described in more detail by means of the figures below. It shows.

DETAILED DESCRIPTION

Figure 1:
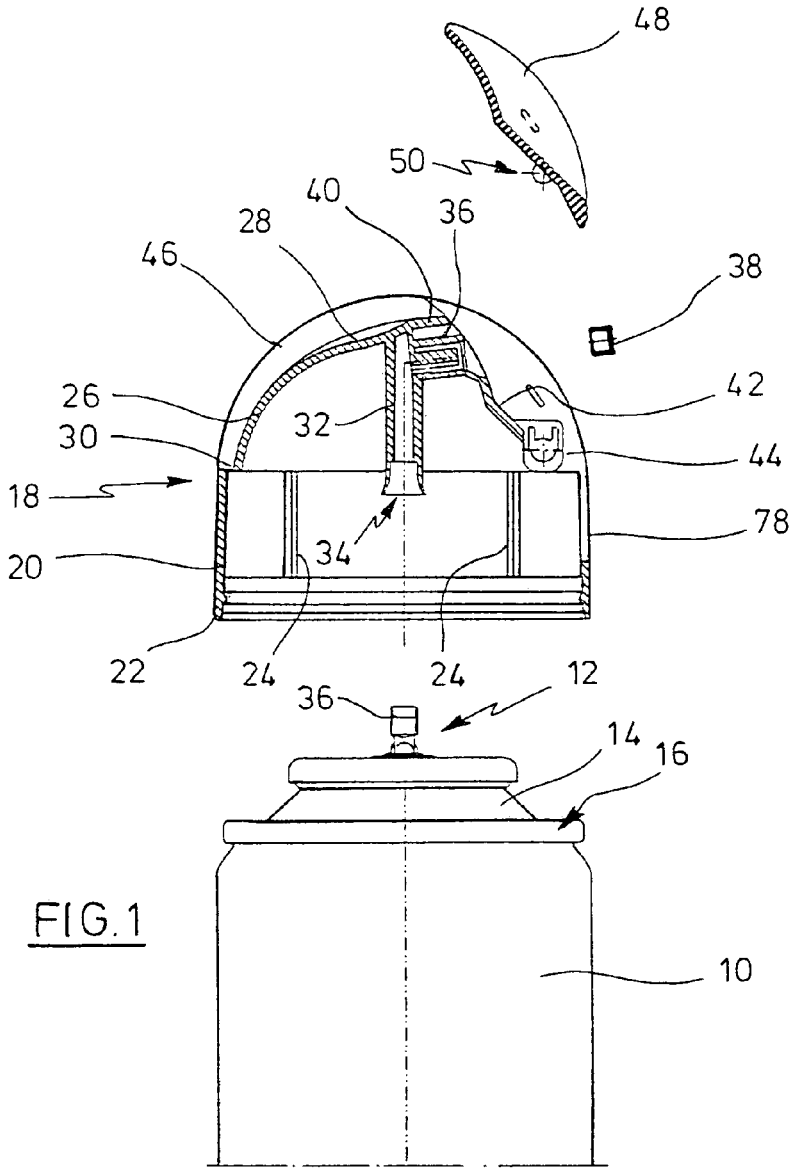
FIG. 1 an inventive spray cap with an aerosol can in a disassembled representation.

FIG. 1 shows an aerosol can 10 with a projecting valve 12. A valve head 14 is joined together with the can wall into a circumferential flange 16 in the region of an outer sealing. The inventive spray cap 18 has an essentially cylindrical attachment piece 20, which has a circumferential projection 22. As is shown in the FIGS. 6 to 9, the projection 22 grasps behind the flange 16 in the exposed condition and thus detachably secures the spraying cap on the spray nozzle 10. In the connection region, two stiffening ribs 24 running in the longitudinal direction are visible.

In the connection region, a convexely vaulted wall element 26 follows up, which forms a pressure region in the form of a finger trough in the region 28. The wall element 26 is attached to the attachment in the region 30, and slewable around the connection region 30 by a force in the pressure region.

A connection piece 32 is provided centrally in the spraying cap 18, which centrally sticks in the spraying cap in the longitudinal direction. The connection piece 32 has an expanded orifice 34 centrally in the spraying cap, by which it is mounted onto the valve stem 36. The connection piece 32 is hollow-shaped and runs out into an off-set nozzle region 36 in the vicinity of the pressure region 28. The nozzle region 36 is prepared for the accommodation of a cylindrical nozzle insert 38.

The wall element 26 continues across the pressure region 28 and the connection piece 32 and has a wall projection 40, which is disposed above the nozzle 36 for its protection. Below the nozzle, in the direction towards the spray container 10, the nozzle region 36 verges into a wall element 42. The wall element 42 has a bearing 44 on its free end. The wall element 42 is connected to the attachment only by the nozzle and the vaulted wall element 26.

Figure 3:
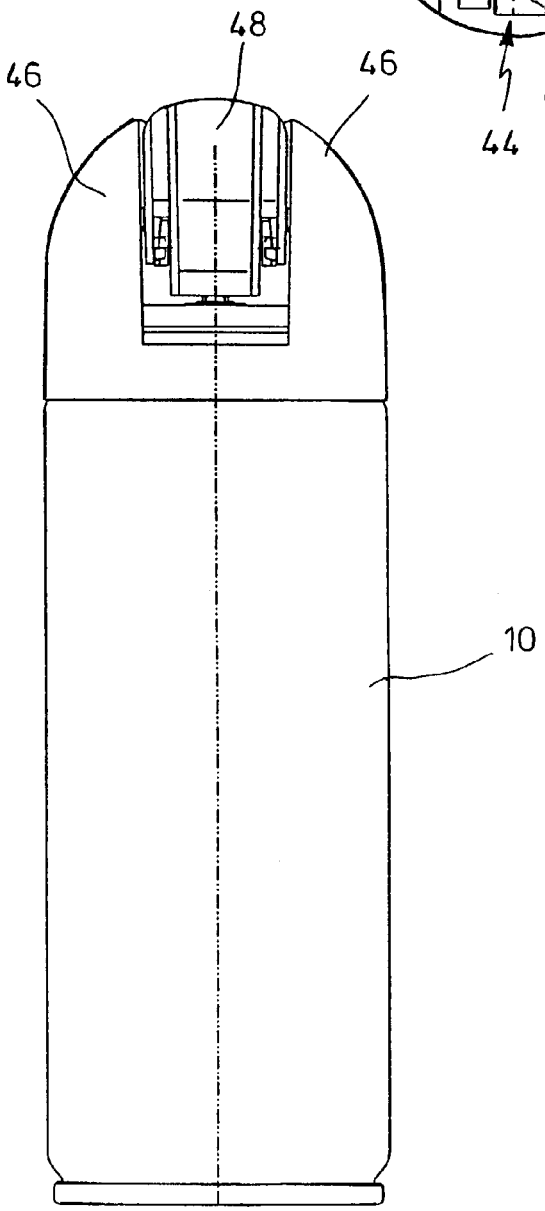
FIG. 3 depicts an aerosol can with spray cap in the locked position of the actuator element.
Figure 5:
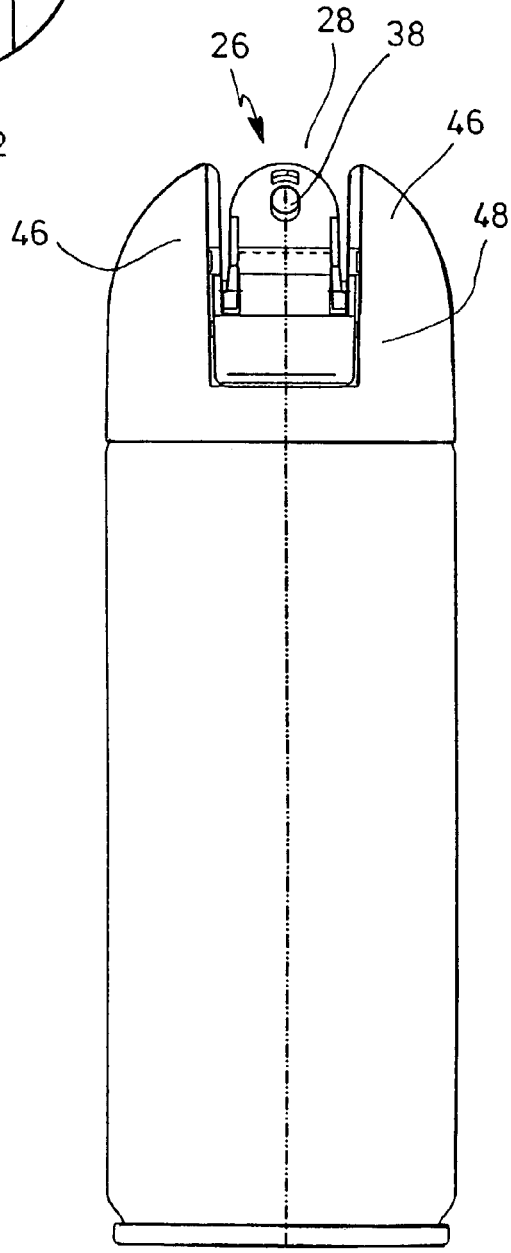
FIG. 5 depicts the aerosol can with the spraying cap from FIG. 4 in the opened position.

The attachment 18 additionally has jacket elements 46, which are clearly recognisable in FIGS. 3 and 5.

In the represented embodiment, the actuator element 48 has a convexely vaulted shape and edgewise one bearing neck, respectively, for the accommodation bearing 44.

Figure 2:
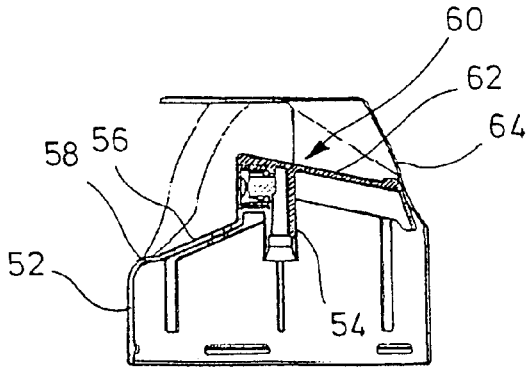
FIG.2 Prior Art
FIG. 2 depicts a spray cap according to the state of the art.

FIG. 2 shows a spraying cap according to the state of the art. The spraying cap has an attachment, by which it can be mounted onto the aerosol can. In the mounted position, the connection piece 44 is attached to the stem of the valve. A wall element 56 is attached to the attachment 52 and flexible in the connection region 58. The connection piece 54 is pressed onto the valve by pressure on a wall element 62 in the region 60. In doing this, the wall element is free and sits closely on a cover 64. The cover 64 extends above the wall element 62 and has an U-shaped gap for actuation (not represented). The functionality of the individual components as well as the possibilities of handling of the inventive spraying cap differ from those of the spraying cap according to FIG. 2. In the known spraying cap, the pressure takes place in the region 60 on a wall element 62, which is not directly connected with the attachment region 52 but via a wall element 56 attached to the valve 66. In contradistinction to this, the inventive spraying cap has a wall element 26, which is connected with the attachment region 20 in the region 30 and actuates the valve by pressure in the region 28. Further, the cover 64 can be omitted in the inventive spraying cap. Further constructional differences and the differing possibilities of handling for the spraying caps will become apparent by means of the following figures.

FIG. 3 shows the inventive spraying cap in its closed position. Together with the jacket portions 46, the actuator element 48 approximately forms the shape of a spherical cap in the region in front of the spray nozzle.

Figure 4:
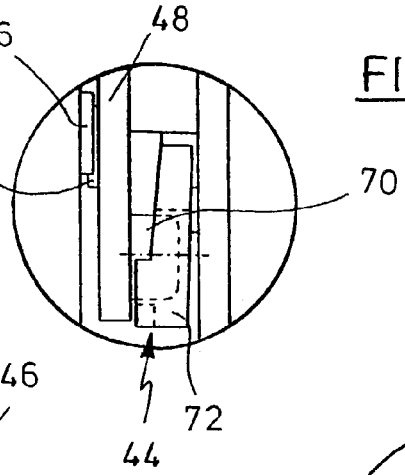
FIG. 4 is a cut-out enlargement from FIG. 3, which shows the catching mechanism for the actuator element.

FIG. 4 shows a detail view from FIG. 3, which shows two interlocking projections 66 and 68, which secure the actuator element 48 in the locked position. The actuator element 48 has a cylindrical bearing neck 70, as can be also seen from FIG. 3 already, which is disposed in a recess 72 of the bearing piece 44 in the inserted condition.

FIG. 5 shows the inventive spraying cap with the actuator element 48 in the opened position. The attachment with the spray nozzle 38 and the insert lay open in this position. In FIG. 5, the trough-shaped pressure region 28 is also not visible. The wall element 26, as well as the jacket elements 46, has essentially the form of a spherical cap.

Figure 6:
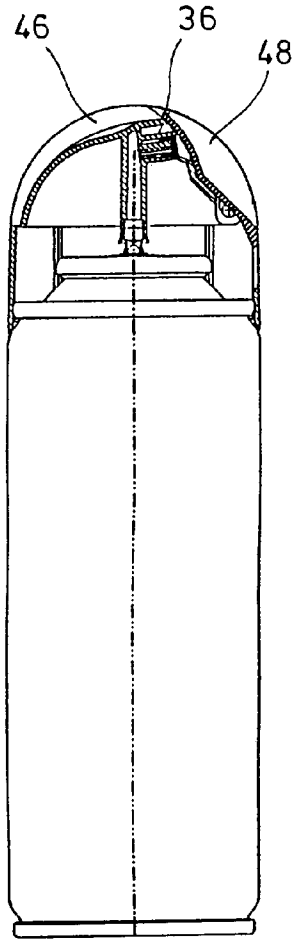
Figure 1:
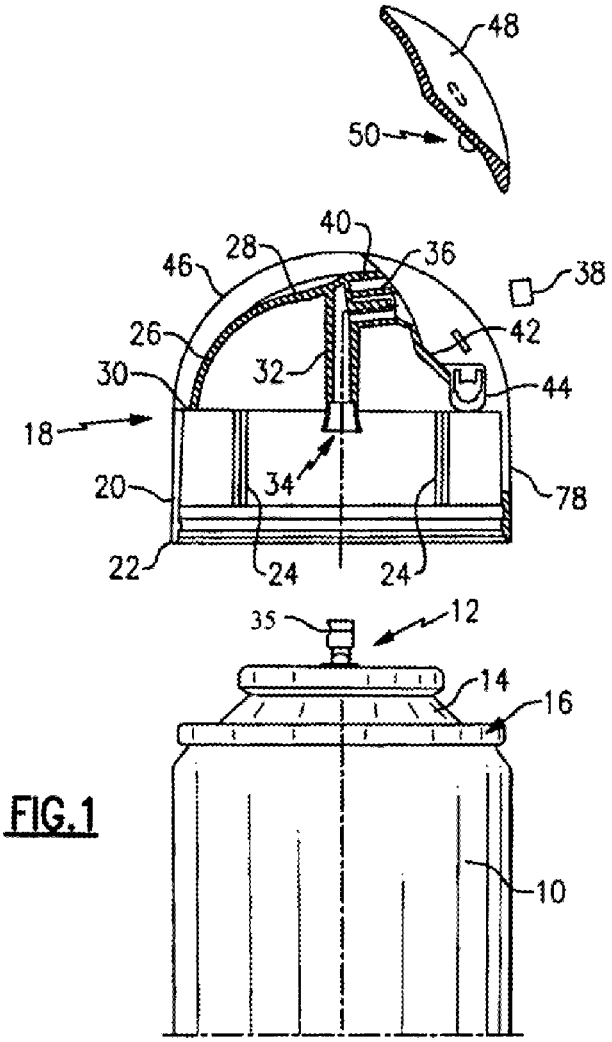
Figure 2:
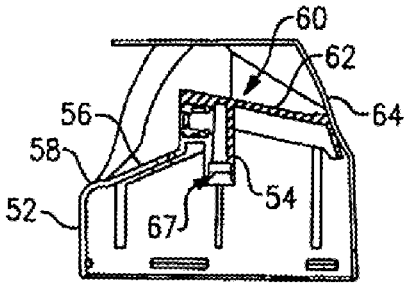
FIG.2 Prior Art

FIG. 6 shows the inventive spraying cap with locked actuator element 48, the actuator element 48 covering the spray nozzle 36 in the spraying direction. Together with the jacket 46, the actuator element 48 forms an approximately spherical contour in front of the spray nozzle.

Figure 7:
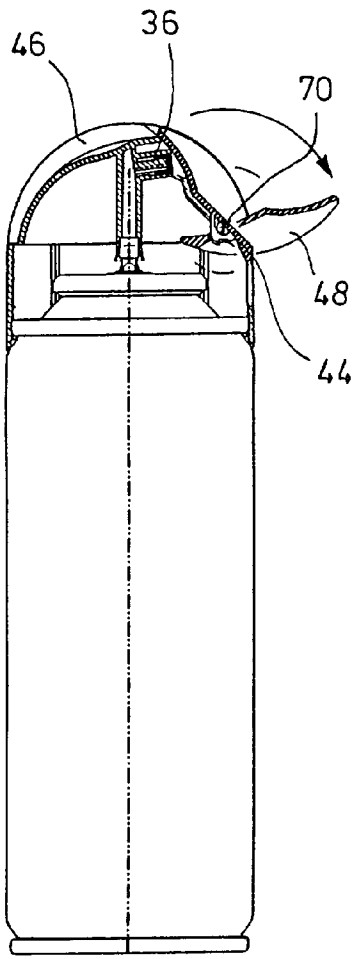

FIG. 7 shows the actuator element 48 in a partly opened position. The actuator element 48 is beared with its lateral necks 70 in the accommodation 44.

Figure 8:
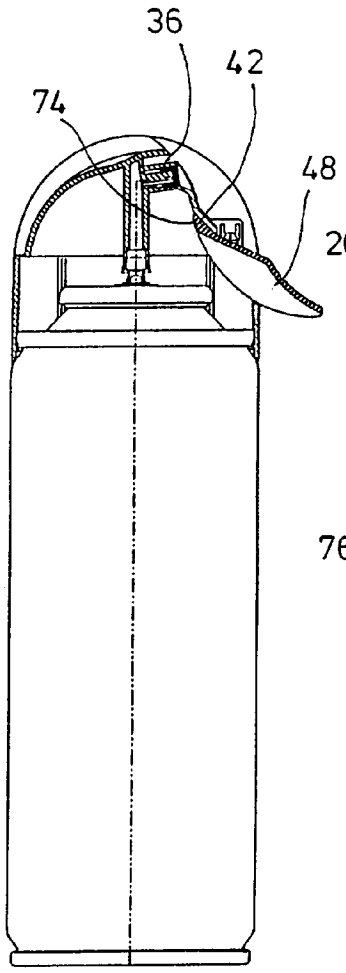

FIG. 8 shows the actuator element 48 in its completely opened position. The end 74 of the actuator element, pointing away from the spray container in the locked position, sits closely on the wall element 42 of the attachment. In the opened position, the spray nozzle 36 is free.

Figure 9:
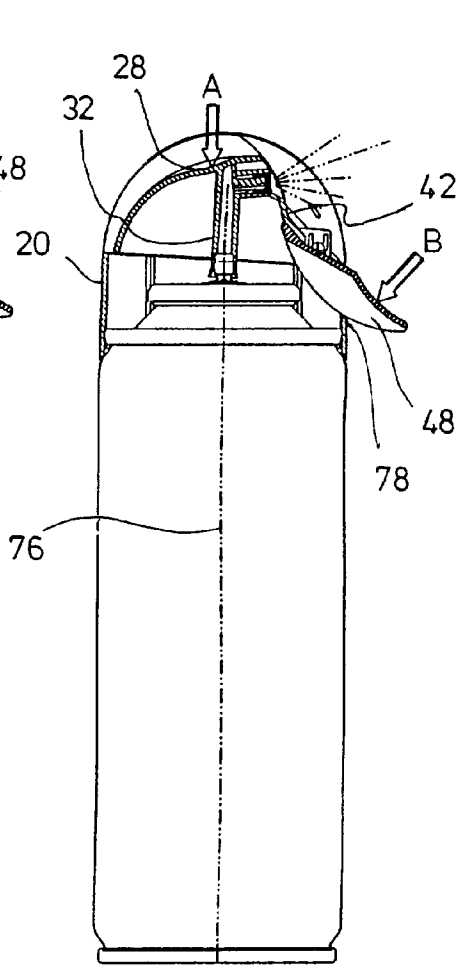
FIGS. 6–9 depict the inventive spraying cap in a partially cut view in different positions for the actuator element.

FIG. 9 indicates the two possible handling modes of the spray container with the arrows A and B. A force on the pressure region 28, essentially in the direction of the arrow A, causes the stem of the valve to be pressed and the medium to be discharged to emerge via the connection piece 32 and the spray nozzle 36. On this occasion, the connection piece 32 can incline slightly with respect to the longitudinal axis 76 of the container. In the second handling variant, the pressure on the actuator element 48 takes place in the direction B. The exerted force is transferred to the connection piece 32 via the wall element 42 and thus actuates the valve. As can be seen from FIG. 9, the motion of the actuator element 48 is limited in that the actuator element 48 is supported in an indentation 78 of the cylindrical attachment region 20.

What is claimed is:

1. A spraying cap for a fingertip spray container with a valve, said spraying cap comprising:

an attachment for the spray container having a connection piece connectable with the valve, which extends into a spray nozzle, an actuator element, slewably mounted on the attachment, which in a locked position at least partially covers the spray nozzle, and in an opened position extends away from the spraying cap, a first pressure region in the attachment proximate the connection piece, and a second pressure region at the free end of the actuator element in the opened position, wherein a force on either the first pressure region or on the actuator element in its opened position second pressure region, wholly or partly pointing into the an actuation direction of the valve, opens the valve.

2. Spraying cap according to claim 1, wherein the connection piece runs in the actuation direction of the valve in a first portion.

3. Spraying cap according to claim 2, wherein an accommodation for a spray insert is provided in a mouth portion for the connection piece.

4. Spraying cap according to claim 1, including a cylindrical attachment portion with inwardly extending projections, which in the mounted position of the spraying cap grasp behind a flange on the spray container.

5. Spraying cap according to claim 4, wherein the attachment portion has reinforcement ribs, running in the actuation direction of the valve.

6. Spraying cap according to claim 1, wherein the actuator element includes two laterally sticking-off pivots.

7. Spraying cap according to claim 6, wherein the attachment includes two accommodation bearings for the pivots.

8. Spraying cap according to claim 5, wherein a portion is provided extending approximately up to the connection piece on a side opposite to the spray nozzle, said portion being attached to the attachment portion and having the pressure region in the region of the connection piece.

9. Spraying cap according to claim 8, including a wall element connected with the spray nozzle, which on a free end bears the accommodation bearings for the actuator element.

10. Spraying cap according to claim 9, wherein the portion is springably connected with the cylindrical attachment portion, the portion in its pressed position pressing the connection piece onto the valve.

11. Spraying cap according to claim 1, wherein the attachment has a projection, which co-operates with at least one projection on the actuator element in order to catch the actuator element in its opened and/or locked position.

12. Spraying cap according to claim 1, wherein the attachment is provided with a vaulted jacket element, having two jacket portions lateral to the spray nozzle, between which the first pressure region, the spray nozzle and the actuator element are disposed.

13. Spraying cap according to claim 12, wherein the attachment extends in a dome-like configuration in the region between the jacket portions.

14. Spraying cap according to claim 12, wherein in its locked position, the actuator element essentially covers the region between the two jacket portions with respect to the spray nozzle.

* * * * *

UNITED STATES PATENT AND TRADEMARK OFFICE

CERTIFICATE OF CORRECTION

PATENT NO. : 7,004,359 B2
APPLICATION NO. : 10/458210
DATED : February 28, 2006
INVENTOR(S) : Alain Marroncles It is certified that error appears in the above-identified patent and that said Letters Patent is hereby corrected as shown below:

The sheet of drawings consisting of figures 1 and 2 should be deleted to appear as per attached sheet.

Figures 1 should be corrected to change "36" adjacent to "12" to read --35--.

Prior Art Fig. 2 reference numeral 67 has been added.

Column 3 line 52 change "...secures the spraying cap on the spray nozzle 10" to read as --...secures the spraying cap on the aerosol can 10--.

Column 3 line 66 please change "valve stem 36" to read as --valve stem 35--.

Column 4 line 20 "connection piece 44" should read as --connection piece 54--.

Column 4 line 33 "valve 66" should read as --valve 67--.

Column 5 line 34, in Claim 1, omit "the".

Signed and Sealed this

Nineteenth Day of February, 2008

JON W. DUDAS
*Director of the United States Patent and Trademark Office*